US009180951B2

(12) United States Patent
Hitachi et al.

(10) Patent No.: US 9,180,951 B2
(45) Date of Patent: Nov. 10, 2015

(54) SHIP MANEUVERING DEVICE

(75) Inventors: Junichi Hitachi, Osaka (JP); Naohiro Hara, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 33 days.

(21) Appl. No.: 14/129,823

(22) PCT Filed: Mar. 29, 2012

(86) PCT No.: PCT/JP2012/058456
§ 371 (c)(1),
(2), (4) Date: Feb. 4, 2014

(87) PCT Pub. No.: WO2013/001876
PCT Pub. Date: Jan. 3, 2013

(65) Prior Publication Data

US 2014/0174331 A1 Jun. 26, 2014

(30) Foreign Application Priority Data

Jun. 30, 2011 (JP) ..... 2011-146743

(51) Int. Cl.
*B63H 21/22* (2006.01)
*B63H 25/42* (2006.01)
(Continued)

(52) U.S. Cl.
CPC ..... *B63H 25/42* (2013.01); *B63H 21/213* (2013.01); *B63H 21/265* (2013.01)

(58) Field of Classification Search
USPC ..... 440/1, 80
IPC ..... B63H 5/07,2021/216
See application file for complete search history.

(56) References Cited

U.S. PATENT DOCUMENTS 6,848,382 B1 2/2005 Bekker
7,677,937 B2 * 3/2010 Ishida et al. ..... 440/1
(Continued)

FOREIGN PATENT DOCUMENTS

EP 1 775 212 A1 4/2007
EP 2 210 810 A2 7/2010
(Continued)

OTHER PUBLICATIONS

Extended European Search Report for European Patent Application No. EP12804380.9, dated Apr. 21, 2015, 6 pages.

*Primary Examiner* — Stephen Avila
(74) *Attorney, Agent, or Firm* — Sterne, Kessler, Goldstein & Fox P.L.L.C.

(57) ABSTRACT

Provided is a ship maneuvering device that can increase operation sensitivity and enables smooth operation when simultaneously operating the rotation component determination unit and the oblique sailing component determination unit of an operation means. In the ship maneuvering device 1, a control device 31 computes a rotation component propulsion vector Trot for rotation and an oblique sailing component propulsion vector $T_{trans}$ for oblique sailing for left and right out-drive units 10A, 10B from the amount of operation of a joystick 21, calculates the combined torque T by combining the rotation component propulsion vector $T_{rot}$ and the oblique sailing component propulsion vector $T_{trans}$ for each of the left and right out-drive units 10A, 10B, and computes the propulsion and orientation for each of the left and right out-drive units 10A, 10B.

4 Claims, 11 Drawing Sheets

(51) Int. Cl.
*B63H 21/21* (2006.01)
*B63H 20/00* (2006.01)

(56) References Cited

U.S. PATENT DOCUMENTS 8,170,734 B2 * 5/2012 Kaji ..... 701/21
2007/0017426 A1 * 1/2007 Kaji et al. ..... 114/144 RE
2007/0082566 A1 4/2007 Okuyama
2009/0197486 A1 8/2009 Szilagyi et al.
2010/0138083 A1 6/2010 Kaji

FOREIGN PATENT DOCUMENTS

JP H01-285486 A 11/1989
JP 2010-126085 A 6/2010

* cited by examiner

SHIP MANEUVERING DEVICE

TECHNICAL FIELD

The present invention relates to an art of a ship maneuvering device.

BACKGROUND ART

Conventionally, a ship is known having an inboard motor (inboard engine, outboard drive) in which a pair of left and right engines are arranged inside a hull and power is transmitted to a pair of left and right outdrive devices arranged outside the hull. The outdrive devices are propulsion devices rotating screw propellers so as to propel the hull, and are rudder devices rotated concerning a traveling direction of the hull so as to make the hull turn.

Such outdrive devices are rotated with hydraulic steering actuators provided in the outdrive devices (for example, see the Patent Literature 1). Then, a rotation angle of each of the outdrive devices, that is, a steering angle is grasped based on detection results of an angle detection sensor and the like provided in a linkage mechanism constituting the outdrive device.

The ship has an operation means setting a traveling direction of the ship. The ship is controlled with a control device so as to travel to the direction set with the operation means.

PRIOR ART REFERENCE

Patent Literature

Patent Literature 1: the Japanese Patent Laid Open Gazette Hei. 1-285486

DISCLOSURE OF INVENTION

Problems to be Solved by the Invention

The operation means has an oblique sailing component determination unit and a turning component determination unit. Conventionally, when the oblique sailing component determination unit and the turning component determination unit are operated simultaneously, priority is not set and action of the hull is unnatural, whereby smooth maneuvering cannot be performed.

In consideration of the above problems, the purpose of the present invention is to provide a ship maneuvering device that can increase operation sensitivity and enables smooth operation when simultaneously operating the oblique sailing component determination unit and the turning component determination unit of an operation means.

Means for Solving the Problems

The problems to be solved by the present invention have been described above, and subsequently, the means of solving the problems will be described below.

According to the present invention, a ship maneuvering device includes a pair of left and right engines, rotation speed changing actuators independently changing engine rotation speeds of the pair of left and right engines, a pair of left and right outdrive devices respectively connected to the pair of left and right engines and rotating screw propellers so as to propel a hull, forward/reverse switching clutches disposed between the engines and the screw propellers, a pair of left and right steering actuators respectively independently rotating the pair of left and right outdrive devices laterally within a predetermined angle range, an operation means setting a traveling direction of a ship, an operation amount detection means detecting the operation amount of the operation means, and a control device controlling the rotation speed changing actuators, the forward/reverse switching clutches, and the steering actuators so as to travel to a direction set by the operation means. The control device calculates oblique sailing component propulsion power vectors for oblique sailing of the left and right outdrive devices and turning component propulsion power vectors for the turning from the operation amount of the operation means, and composes the oblique sailing component propulsion power vectors and the turning component propulsion power vectors of the left and right outdrive devices so as to calculates composition vectors, thereby calculating propulsion powers and directions of the left and right outdrive devices.

According to the present invention, when directions of the composition vector is within a range over a predetermined angle range of the outdrive device, the outdrive device is controlled so as to be made a predetermined limiting angle mode and the engine rotation speed is reduced to a set rotation speed.

According to the present invention, when the direction of the composition vector is within a range over a predetermined angle range of the outdrive device, a rotation angle of the outdrive device is fixed at a state of a predetermined limiting angle.

According to the present invention, when a direction of the composition vector is within a range over a predetermined angle range of the outdrive device, the engine rotation speed of the engine is reduced following reduction of a minor angle between the direction of the composition vector and a lateral direction of the hull.

Effect of the Invention

The present invention brings the following effects.

According to the present invention, in comparison with the case of calculating the propulsion powers and the directions of the left and right outdrive devices based on only the oblique sailing component propulsion power vectors and subsequently calculating the propulsion powers and the directions of the left and right outdrive devices based on only the turning component propulsion power vectors, by calculating the composition vectors based on the oblique sailing component propulsion power vectors and the turning component propulsion power vectors, smooth operation is obtained and operability is improved. Since the oblique sailing component propulsion power and the turning component propulsion power can be controlled independently, the components do not interfere with each other, whereby a turning moment generated at the time of the turning operation has always the same characteristics regardless of the input of the oblique sailing operation. Accordingly, in the ship having this control, accuracy of correction of the turning direction is improved.

According to the present invention, even if the direction of the composition vector is over the predetermined angle range of the outdrive device, the steering of the outdrive device can be corrected.

According to the present invention, when the direction of the composition vector is over the predetermined angle range of the outdrive devices, frequent change of the rotation angle and frequent switching of forward/reverse rotation of the outdrive device is prevented.

According to the present invention, when the direction of the composition vector is over the predetermined angle range of the outdrive devices, the switching of forward/reverse rotation of the outdrive devices can be performed smoothly.

BRIEF DESCRIPTION OF DRAWINGS

FIG. 1 is a drawing of a ship according to an embodiment of the present invention.

FIG. 2 is a left side view partially in section of an outdrive device according to the embodiment of the present invention.

FIG. 3 is a right side view partially in section of the outdrive device according to the embodiment of the present invention.

FIG. 4 is a drawing of an operation device.

FIG. 5 is a block diagram of a control device.

FIG. 6 is a flow chart of a calculation method of propulsion powers and directions of left and right outdrive devices.

FIG. 7(A) is a drawing of oblique sailing component propulsion power vectors of the outdrive devices. FIG. 7(B) is a drawing of turning component propulsion power vectors of the outdrive devices. FIG. 7(C) is a drawing of composition vectors of the outdrive devices.

FIG. 8 is a plan view of a rotation angle of the outdrive device.

FIG. 9 is a graph of relation of the angle of the composition vector and the rotation angle of the outdrive device.

FIG. 10 is a plan view of the rotation angle of the outdrive device.

FIG. 11 is a graph of relation of the rotation angle of the outdrive device and a reduction rate of an engine rotation speed.

DESCRIPTION OF NOTATIONS

1 ship maneuvering device
2 hull
3A and 3B engines
4A and 4B rotation speed changing actuators
10A and 10B outdrive devices
15A and 15B screw propellers
16A and 16B forward/reverse switching clutches
17A and 17B hydraulic steering actuators
21 joystick (operation means)
31 control device
39 operation amount detection sensor (operation amount detection means)
$T_{Atrans}$ and $T_{Btrans}$ oblique sailing component propulsion power vectors
$T_{Arot}$ and $T_{Brot}$ turning component propulsion power vectors
$T_A$ and $T_B$ composition vectors
$\beta$ angles of composition vectors
$\theta_A$ and $\theta_B$ rotation angles of outdrive devices

DETAILED DESCRIPTION OF THE INVENTION

Firstly, an explanation will be given on a ship maneuvering device according to an embodiment of the present invention.

Figure 1:
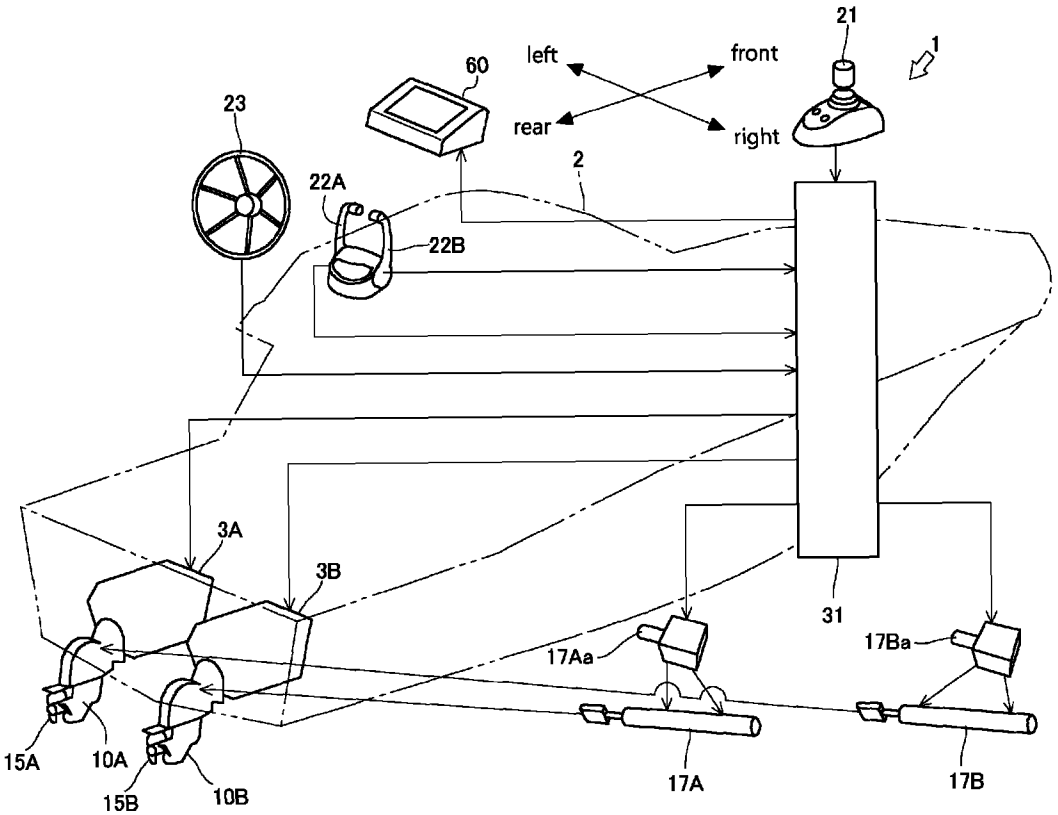
[FIG. 1]
Figure 2:
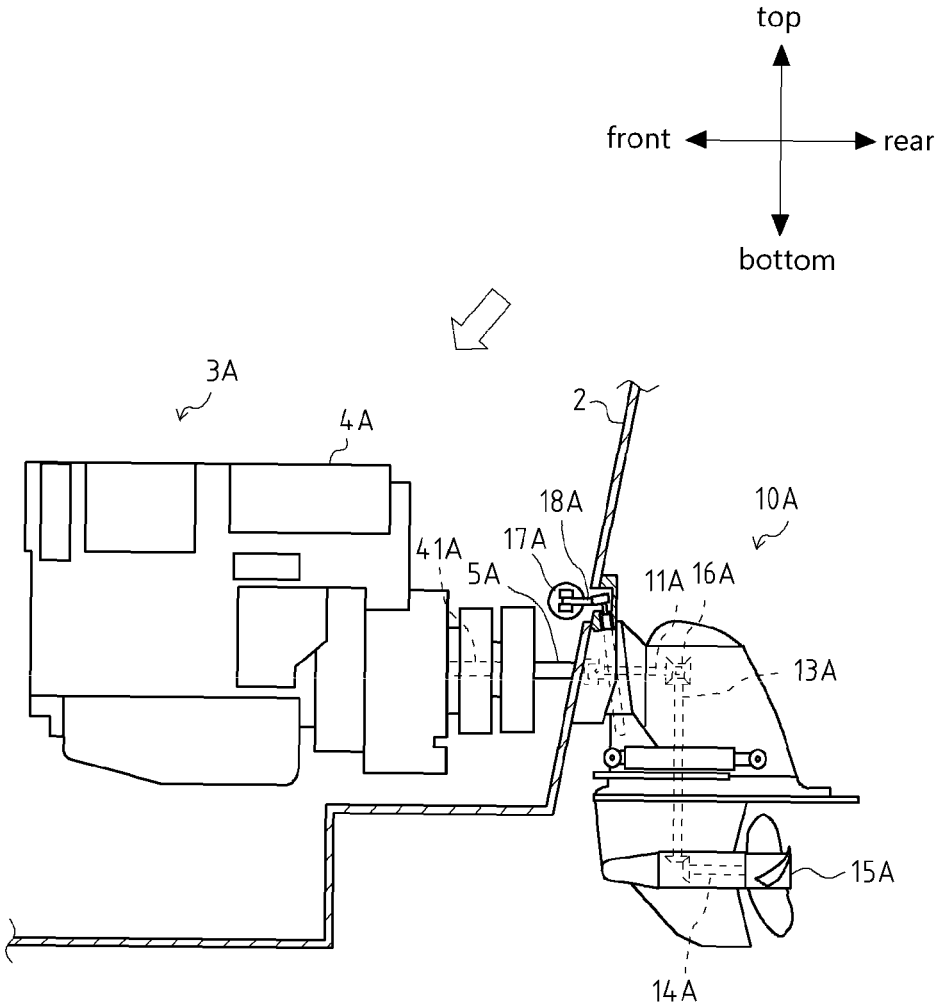
[FIG. 2]
Figure 3:
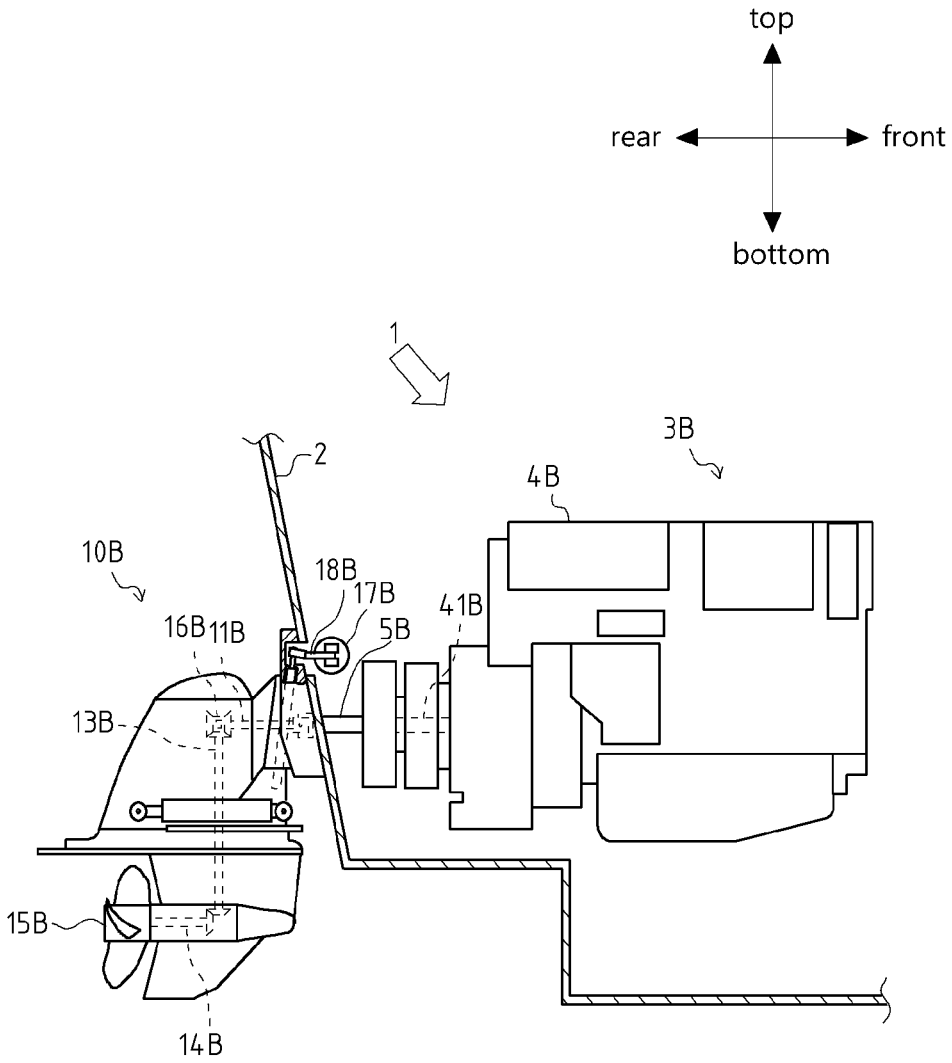
[FIG. 3]

As shown in FIGS. 1, 2 and 3, a ship maneuvering device 1 has a pair of left and right engines 3A and 3B, rotation speed changing actuators 4A and 4B independently changing engine rotation speeds $N_A$ and $N_B$ of the pair of left and right engines 3A and 3B, a pair of left and right outdrive devices 10A and 10B respectively connected to the pair of left and right engines 3A and 3B and rotating screw propellers 15A and 15B so as to propel a hull 2, forward/reverse switching clutches 16A and 16B disposed between the engines 3A and 3B and the screw propellers 15A and 15B, a pair of left and right hydraulic steering actuators 17A and 17B respectively independently rotating the pair of left and right outdrive devices 10A and 10B laterally, electromagnetic valves 17Aa and 17Ba controlling hydraulic pressure in the hydraulic steering actuators 17A and 17B, a joystick 21, accelerator levers 22A and 22B and an operation wheel 23 as operation means setting a traveling direction of the ship, an operation amount detection sensor 39 (see FIG. 5) as an operation amount detection means detecting an operation amount of the joystick 21, operation amount detection sensor 43A and 43B (see FIG. 5) as operation amount detection means detecting operation amounts of the accelerator levers 22A and 22B, an operation amount detection sensor 44 (see FIG. 5) as an operation amount detection means detecting an operation amount of the operation wheel 23, and a control device 31 (see FIG. 5) controlling the rotation speed changing actuators 4A and 4B, the forward/reverse switching clutches 16A and 16B, the hydraulic steering actuators 17A and 17B and the electromagnetic valves 17Aa and 17Ba so as to travel to a direction set by the joystick 21, the accelerator levers 22A and 22B and the operation wheel 23.

The engines 3A and 3B are arranged in a rear portion of the hull 2 as a pair laterally, and are connected to the outdrive devices 10A and 10B arranged outside the ship. The engines 3A and 3B have output shafts 41A and 41B for outputting rotation power.

The rotation speed changing actuators 4A and 4B are means controlling the engine rotation power, and changes a fuel injection amount of a fuel injection device and the like so as to control engine rotation speeds of the engines 3A and 3B.

The outdrive devices 10A and 10B are propulsion devices rotating the screw propellers 15A and 15B so as to propel the hull 2, and are provided outside the rear portion of the hull 2 as a pair laterally. The pair of left and right outdrive devices 10A and 10B are respectively connected to the pair of left and right engines 3A and 3B. The outdrive devices 10A and 10B are rudder devices which are rotated concerning the traveling direction of the hull 2 so as to make the hull 2 turn. The outdrive devices 10A and 10B mainly include input shafts 11A and 11B, the forward/reverse switching clutches 16A and 16B, drive shafts 13A and 13B, final output shaft 14A and 14B, and the rotating screw propellers 15A and 15B.

The input shafts 11A and 11B transmit rotation power. In detail, the input shafts 11A and 11B transmit rotation power of the engines 3A and 3B, transmitted from the output shafts 41A and 41B of the engines 3A and 3B via universal joints 5A and 5B, to the forward/reverse switching clutches 16A and 16B. One of ends of each of the input shafts 11A and 11B is connected to corresponding one of the universal joints 5A and 5B attached to the output shafts 41A and 41B of the engines 3A and 3B, and the other end thereof is connected to corresponding one of the forward/reverse switching clutches 16A and 16B.

The forward/reverse switching clutches 16A and 16B are arranged between the engines 3A and 3B and the rotating screw propellers 15A and 15B, and switch rotation direction of the rotation power. In detail, the forward/reverse switching clutches 16A and 16B are rotation direction switching devices which switch the rotation power of the engines 3A and 3B, transmitted via the input shafts 11A and 11B and the like, to forward or reverse direction. The forward/reverse switching clutches 16A and 16B have forward bevel gears and reverse bevel gears which are connected to inner drums having disc plates, and pressure plates of outer drums connected to the input shafts 11A and 11B is pressed against the disc plates of the forward bevel gears or the reverse bevel gears so as to switch the rotation direction.

The drive shafts 13A and 13B transmit the rotation power. In detail, the drive shafts 13A and 13B are rotation shafts which transmit the rotation power of the engines 3A and 3B, transmitted via the forward/reverse switching clutches 16A and 16B and the like, to the final output shaft 14A and 14B. A bevel gear provided at one of ends of each of the drive shafts 13A and 13B is meshed with the forward bevel gear and the reverse bevel gear provided on corresponding one of the forward/reverse switching clutches 16A and 16B, and a bevel gear provided at the other end is meshed with a bevel gear provided on corresponding one of the final output shaft 14A and 14B.

The final output shaft 14A and 14B transmit the rotation power. In detail, the final output shaft 14A and 14B are rotation shafts which transmit the rotation power of the engines 3A and 3B, transmitted via the drive shafts 13A and 13B and the like, to the screw propellers 15A and 15B. As mentioned above, the bevel gear provided at one of ends of each of the final output shaft 14A and 14B is meshed with the bevel gear of corresponding one of the drive shafts 13A and 13B, and the other end is attached thereto with corresponding one of the screw propellers 15A and 15B.

The screw propellers 15A and 15B are rotated so as to generate propulsion power. In detail, the screw propellers 15A and 15B are driven by the rotation power of the engines 3A and 3B transmitted via the final output shaft 14A and 14B and the like so that a plurality of blades arranged around the rotation shafts paddle surrounding water, whereby the propulsion power is generated.

The hydraulic steering actuators 17A and 17B are hydraulic devices which drive steering arms 18A and 18B so as to rotate the outdrive devices 10A and 10B. The hydraulic steering actuators 17A and 17B are provided therein with the electromagnetic valves 17Aa and 17Ba for controlling hydraulic pressure, and the electromagnetic valves 17Aa and 17Ba are connected to the control device 31.

The hydraulic steering actuators 17A and 17B are so-called single rod type hydraulic actuators. However, the hydraulic steering actuators 17A and 17B may alternatively be double rod type.

The joystick 21 as the operation means is a device determining the traveling direction of the ship, and is provided near an operator's seat of the hull 2. A plane operation surface of the joystick 21 is an oblique sailing component determination part 21*a*, and a torsion operation surface thereof is a turning component determination part 21*b*.

Figure 4:
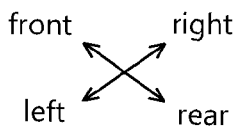
[FIG. 4]
Figure 4:
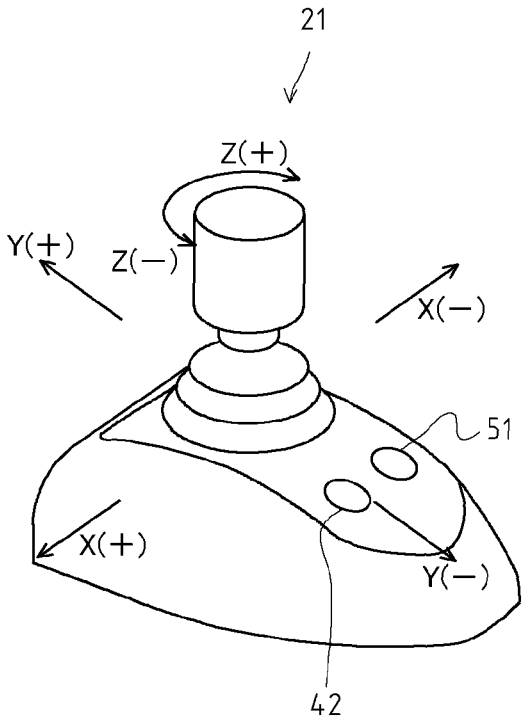

The joystick 21 can be moved free within the operation surface parallel to an X-Y plane shown in FIG. 4, and a center of the operation surface is used as a neutral starting point. Longitudinal and lateral directions in the operation surface correspond to the traveling direction, and an inclination amount of the joystick 21 corresponds to a target hull speed. The target hull speed is increased corresponding to increase of the inclination amount of the joystick 21.

The torsion operation surface is provided with the joystick 21, and by twisting the joystick 21 concerning a Z axis extended substantially perpendicularly to the plane operation surface as a turning axis, a turning speed can be changed. A torsion amount of the joystick 21 corresponds to a target turning speed. A maximum target lateral turning speed is set at fixed turning angle positions of the joystick 21.

The accelerator levers 22A and 22B as the operation means are devices determining the target hull speed of the ship, and are provided near the operator's seat of the hull 2. The two accelerator levers 22A and 22B are provided so as to correspond respectively to the left and right engines 3A and 3B. The rotation speed of the engine 3A is changed by operating the accelerator lever 22A, and the rotation speed of the engine 3B is changed by operating the accelerator lever 22B.

The operation wheel 23 as the operation means is a device determining the traveling direction of the ship, and is provided near the operator's seat of the hull 2. The traveling direction is changed widely following increase of a rotation amount of the operation wheel 23.

A correction control start switch 42 (see FIG. 5) is a switch for starting correction control of turning action of the hull 2.

The correction control start switch 42 is provided near the joystick 21 and is connected to the control device 31.

Figure 5:
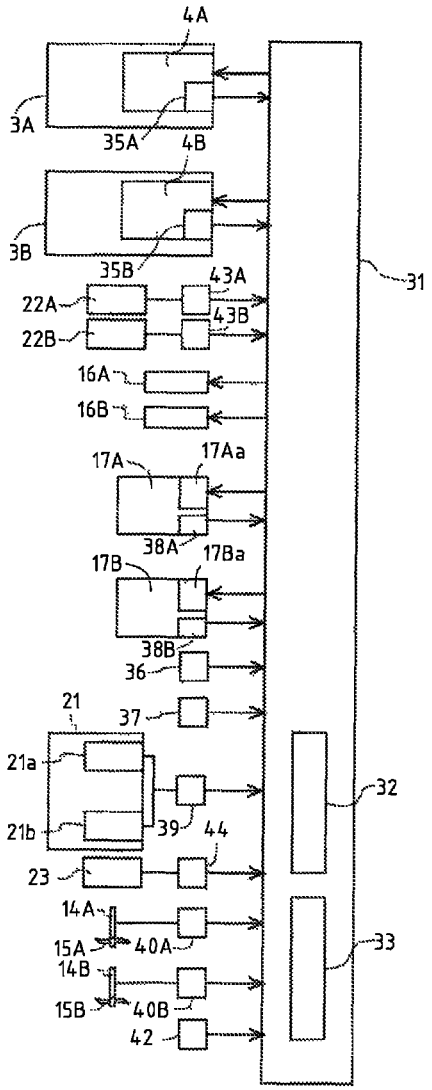
[FIG. 5]

Next, an explanation will be given on various kinds of detection means referring to FIG. 5.

Rotation speed detection sensors 35A and 35B as rotation speed detection means are means for detecting engine rotation speeds $N_A$ and $N_B$ of the engines 3A and 3B and are provided in the engines 3A and 3B.

An elevation angle sensor 36 as an elevation angle detection means is a means for detecting an elevation angle a of the hull 2. The elevation angle indicates inclination of the hull in the water concerning a flow.

A hull speed sensor 37 as a hull speed detection means is a means for detecting a hull speed V, and is an electromagnetic log, a Doppler sonar or a GPS for example.

Lateral rotation angle detection sensors 38A and 38B as lateral rotation angle detection means are means for detecting lateral rotation angles $\theta_A$ and $\theta_B$ of the outdrive devices 10A and 10B. The lateral rotation angle detection sensors 38A and 38B are provided near the hydraulic steering actuators 17A and 17B, and detect the lateral rotation angles $\theta_A$ and $\theta_B$ of the outdrive devices 10A and 10B based on the drive amounts of the hydraulic steering actuators 17A and 17B.

The operation amount detection sensor 39 as the operation amount detection means is a sensor for detecting the operation amount in the plane operation surface and the operation amount in the torsion operation surface of the joystick 21. The operation amount detection sensor 39 detects an inclination angle and an inclination direction of the joystick 21. The operation amount detection sensor 39 detects the torsion amount of the joystick 21.

The operation amount detection sensors 43A and 43B as the operation amount detection means are sensors for detecting the operation amounts of the accelerator levers 22A and 22B. The operation amount detection sensors 43A and 43B detect inclination angles of the accelerator levers 22A and 22B.

The operation amount detection sensor 44 as the operation amount detection means is a sensor for detecting the operation amount of the operation wheel 23. The operation amount detection sensor 44 detects the rotation amount of the operation wheel 23.

Outdrive device rotation speed detection sensors 40A and 40B as rotation speed detection means of the outdrive devices 10A and 10B are sensors for detecting rotation speeds of the screw propellers 15A and 15B of the outdrive devices 10A and 10B, and are provided at middle portions of the final output shaft 14A and 14B. The outdrive device rotation speed detection sensors 40A and 40B detect outdrive device rotation speeds $ND_A$ and $ND_B$.

The control device 31 controls the rotation speed changing actuators 4A and 4B, the forward/reverse switching clutches 16A and 16B and the hydraulic steering actuators 17A and 17B so that the ship travels to the direction set by the joystick 21. The control device 31 is connected respectively to the rotation speed changing actuators 4A and 4B, the forward/reverse switching clutches 16A and 16B, the hydraulic steering actuators 17A and 17B, the electromagnetic valves 17Aa and 17Ba, the joystick 21, the accelerator levers 22A and 22B, the operation wheel 23, the rotation speed detection sensors 35A and 35B, the elevation angle sensor 36, the hull speed sensor 37, the lateral rotation angle detection sensors 38A and 38B, the operation amount detection sensor 39, the operation amount detection sensors 43A and 43B, the operation amount detection sensor 44, and the outdrive device rotation speed detection sensors 40A and 40B. The control device 31 includes a calculation means 32 having a CPU (central processing unit) and a storage means 33 such as a ROM, a RAM or a HDD.

Figure 6:
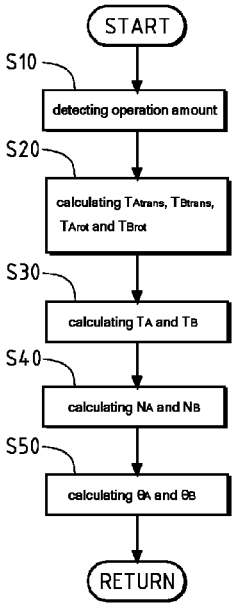
[FIG. 6]

Next, an explanation will be given on a method for calculating the propulsion powers and directions of the left and right outdrive devices 10A and 10B with the control device 31 referring to FIG. 6.

Firstly, an operation amount of the joystick 21 is detected (step S10), and based on the operation amount of the joystick 21, oblique sailing component propulsion power vectors $T_{Atrans}$ and $T_{Btrans}$ for the oblique sailing and turning component propulsion power vectors $T_{Arot}$ and $T_{Brot}$ for the turning of the left and right outdrive devices 10A and 10B are calculated respectively (step S20).

Figure 7:
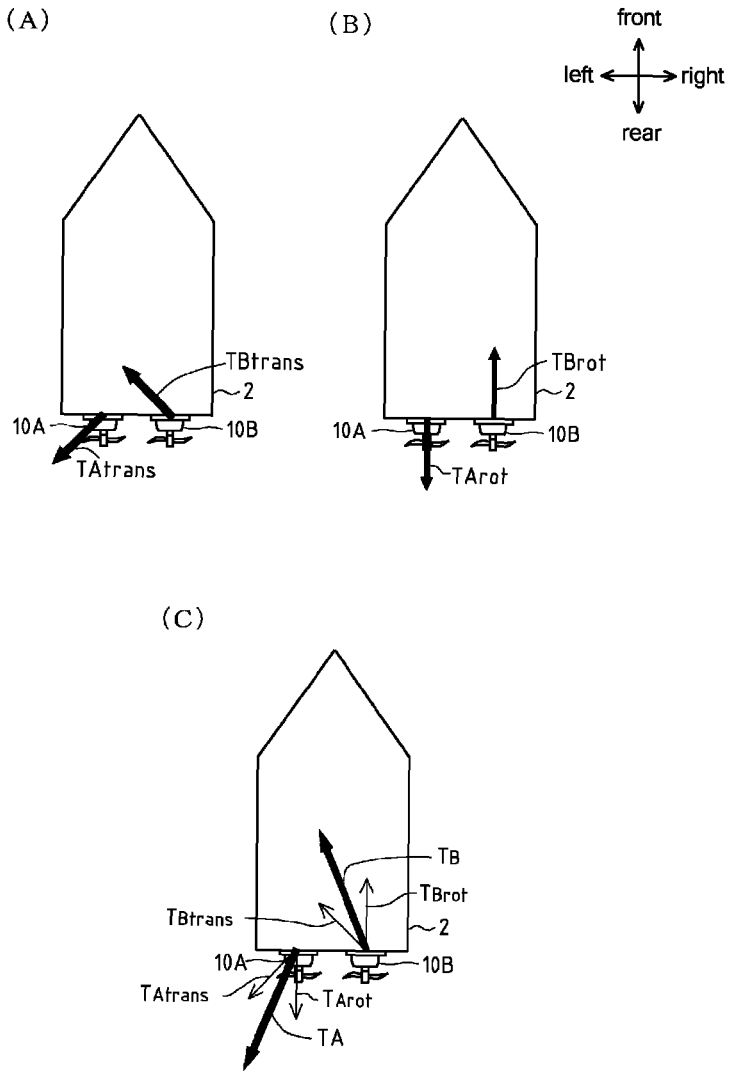
[FIG. 7]

The operation amount of the joystick 21 is the inclination angle, the inclination direction and a torsion amount of the joystick 21, and detected with the operation amount detection sensor 39. Then, based on the operation amounts, the control device 31 calculates the oblique sailing component propulsion power vectors $T_{Atrans}$ and $T_{Btrans}$ for the oblique sailing and the turning component propulsion power vectors $T_{Arot}$ and $T_{Brot}$ for the turning of the left and right outdrive devices 10A and 10B. The oblique sailing component propulsion power vectors $T_{Atrans}$ and $T_{Btrans}$ of the left and right outdrive devices 10A and 10B are calculated as shown in FIG. 7(A). The turning component propulsion power vectors $T_{Arot}$ and $T_{Brot}$ of the left and right outdrive devices 10A and 10B are calculated as shown in FIG. 7(B).

Next, the oblique sailing component propulsion power vectors $T_{Atrans}$ and $T_{Btrans}$ and the turning component propulsion power vectors $T_{Arot}$ and $T_{Brot}$ of the left and right outdrive devices 10A and 10B are composed respectively so as to calculate the propulsion powers and the directions of the left and right outdrive devices 10A and 10B (step S30).

As shown in FIG. 7(C), vectors $T_A$ and $T_B$ are calculated by composing the oblique sailing component propulsion power vectors $T_{Atrans}$ and $T_{Btrans}$ and the turning component propulsion power vectors $T_{Arot}$ and $T_{Brot}$ of the left and right outdrive devices 10A and 10B calculated at the step S20.

Next, based on norms of the composited vectors $T_A$ and $T_B$, the control device 31 calculates a rotation speed N of each of the left and right engines 3A and 3B (step S40), the forward/reverse switching clutches 16A and 16B are switched, and the left and right engines 3A and 3B are driven. Based on the directions of the composited vectors $T_A$ and $T_B$, the lateral rotation angles $\theta_A$ and $\theta_B$ of the outdrive devices 10A and 10B are calculated respectively (step S50), and the hydraulic steering actuators 17A and 17B are driven.

Next, an explanation will be given on a process of restriction of the lateral rotation angles of the pair of left and right outdrive devices 10A and 10B at the calculation of the rotation angles $\theta_A$ and $\theta_B$ at the step S50. Since the same process is performed concerning the pair of left and right outdrive devices 10A and 10B, the process of restriction of the lateral rotation angle of the one outdrive device 10A is described.

When the angle (direction) $\beta$ of the composition vectors $T_A$ is over a predetermined angle range of the outdrive device 10A at the step S50 in the flow chart, the outdrive device 10A is controlled so as to be at a predetermined limiting angle mode.

Figure 8:
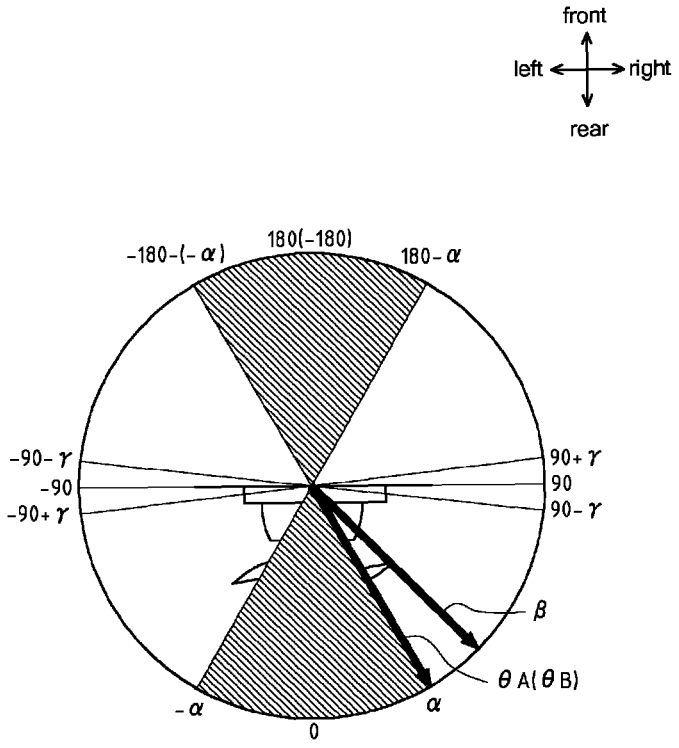
[FIG. 8]

Herein, the predetermined angle range is a range shown with slashes in FIG. 8, and is an angle range in which the outdrive device 10A can be rotated. Since the hydraulic steering actuator 17A is constructed by a hydraulic cylinder and its rotation range is limited, the predetermined angle range is provided. When the predetermined angle range is referred to as $\theta_1$, a limiting angle is referred to as $\alpha$, and the rear side is regarded as 0°, the relation thereof is $-\alpha<\theta_1\leq\alpha$. Since the rotation of the engine 3A can be switched between forward and reverse rotations with the forward/reverse switching clutch 16A, centering on the front side, in other words,) 180° (−180°), the lateral angle is $-180°<\theta_1\leq180°-(-\alpha)$, $180°-\alpha<\theta_1\leq180°$. For example, when $\alpha$ is 30°, the predetermined angle range is $-180°<\theta_1\leq-150°$, $-30°<\theta_1\leq30°$, $150°<\theta_1\leq180°$.

Next, an explanation will be given on the limiting angle mode.

Figure 9:
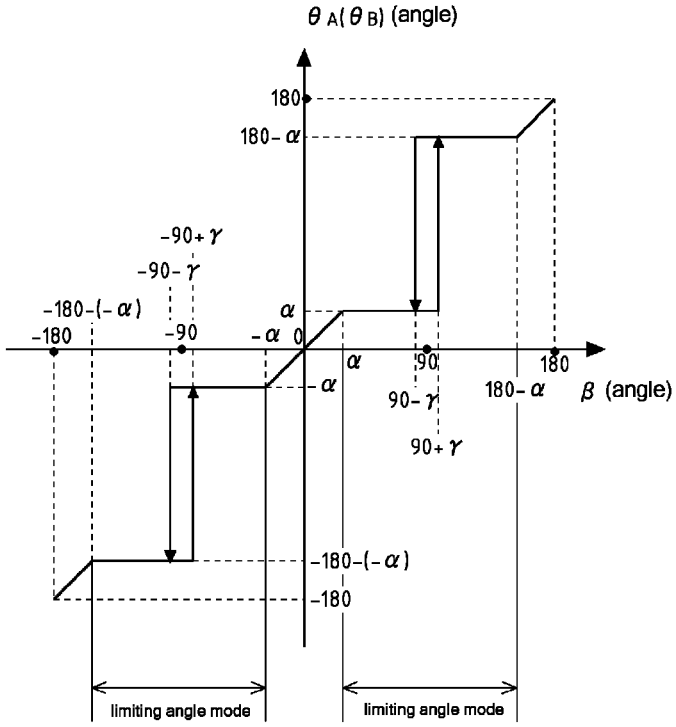
[FIG. 9]

In the limiting angle mode, for obtaining smooth action following the operation of the joystick 21, the driving is performed with reduced propulsion power. Namely, the engine rotation speed $N_A$ is reduced to a set rotation speed $N_{set}$. In the limiting angle mode, the rotation angle $\theta_A$ of the outdrive device 10A is fixed at a state of a predetermined limiting angle. Concretely, by the angle (direction) $\beta$ of the composition vectors $T_A$ determined with the control device 31, the lateral rotation angle $\theta_A$ of the outdrive device 10A is determined. As shown in FIG. 9, in the case in which an X axis indicates the angle $\beta$ of the composition vector $T_A$ and a Y axis indicates the lateral rotation angle $\theta_A$ of the outdrive device 10A, when the angle $\beta$ of the composition vector $T_A$ is within a range of $-180°-(-\alpha)<\beta\leq-90°$, the lateral rotation angle $\theta_A$ of the outdrive device 10A is $-180°-(-\alpha)$. When the angle $\beta$ of the composition vector $T_A$ is within a range of $-90°<\beta\leq-\alpha$, the lateral rotation angle $\theta_A$ of the outdrive device 10A is $(-\alpha)$. When the angle $\beta$ of the composition vector $T_A$ is within a range of $\alpha<\beta\leq90°$, the lateral rotation angle $\theta_A$ of the outdrive device 10A is $\alpha$. When the angle $\beta$ of the composition vector $T_A$ is within a range of $90°<\beta\leq180°-\alpha$, the lateral rotation angle $\theta_A$ of the outdrive device 10A is $180°-\alpha$.

As shown in FIG. 9, in the limiting angle mode, a play tolerance (hysteresis) is set so as to prevent frequent change of the rotation angle $\theta_A$ of the outdrive device 10A.

In the case in which the angle $\beta$ of the composition vector $T_A$ is within a range of $-180°-(-\alpha)<\beta\leq-90°$, when the angle $\beta$ of the composition vector $T_A$ is larger than $-90°+\gamma$, the rotation angle $\theta_A$ of the outdrive device 10A is $(-\alpha)$. In the case in which the angle $\beta$ of the composition vector $T_A$ is within a range of $-90°<\beta\leq-\alpha$, when the angle $\beta$ of the composition vector $T_A$ is not more than $-90°-\gamma$, the rotation angle $\theta_A$ of the outdrive device 10A is $-180°-(-\alpha)$.

In the case in which the angle $\beta$ of the composition vector $T_A$ is within a range of $\alpha<\beta\leq90°$, when the angle $\beta$ of the composition vector $T_A$ is larger than $90°+\gamma$, the rotation angle $\theta_A$ of the outdrive device 10A is $180°-\alpha$. In the case in which the angle $\beta$ of the composition vector $T_A$ is within a range of $90°<\beta\leq180°-\alpha$, when the direction of the composition vector $T_A$ is not more than $90°-\gamma$, the rotation angle $\theta_A$ of the outdrive device 10A is $\alpha$.

In the limiting angle mode, the engine rotation speed $N_A$ of the engine 3A may alternatively be reduced following reduction of a minor angle between the direction of the composition vector $T_A$ and the lateral direction of the hull 2. Following the reduction of the angle between the direction of the composition vector $T_A$ and the lateral direction of the hull (90° and −90°), that is, following approach of the angle β of the composition vector $T_A$ to 90° or −90°, the engine rotation speed $N_A$ of the engine 3A is reduced.

Figure 10:
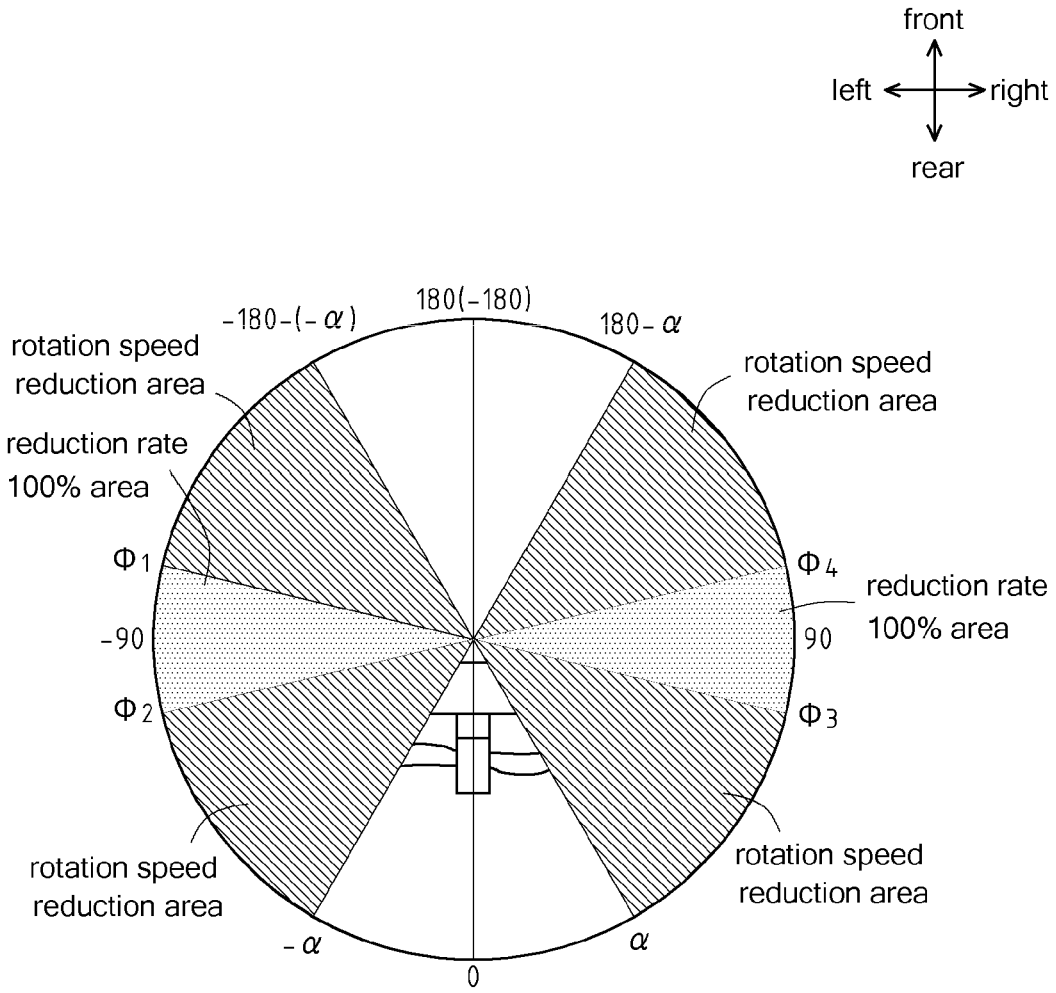
[FIG. 10]
Figure 11:
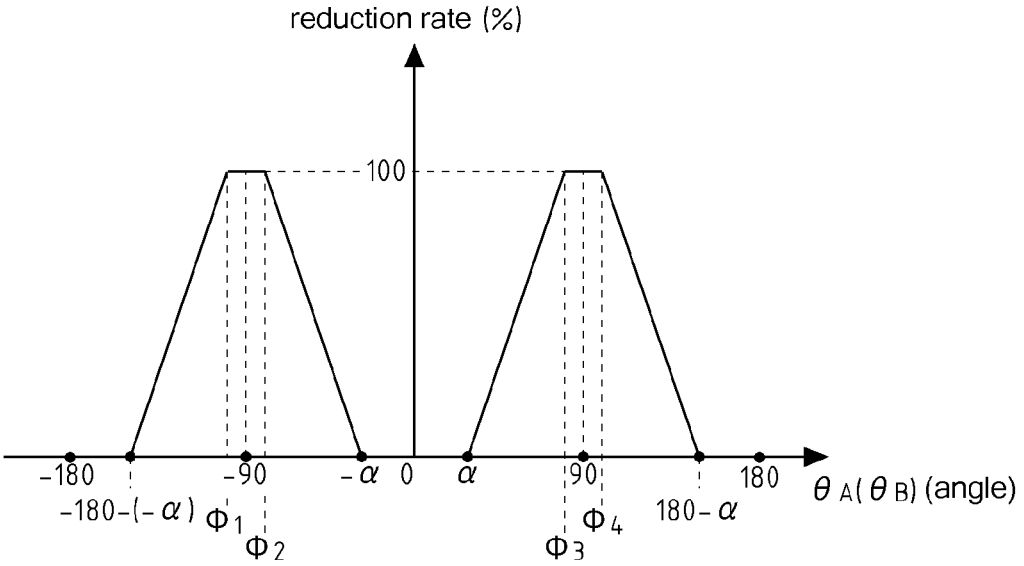
[FIG. 11]

As shown in FIGS. 10 and 11, in the limiting angle mode, by increasing a rotation reduction rate of the engine 3A, the engine rotation speed $N_A$ is reduced.

An area shown with slashes in FIG. 10 is a rotation speed reduction area in which the engine rotation speed $N_A$ is reduced gradually, and a colored area is a reduction rate 100% area in which the reduction rate of the engine rotation speed $N_A$ is 100%.

Concretely, as shown in FIG. 11, within a range larger than −180°−(−α) and not more than Φ1, the reduction rate is increased following the increase of the angle β of the composition vector $T_A$, and at Φ1, the reduction rate is 100%, that is, the engine rotation speed $N_A$ is a low idling rotation speed.

When the angle β of the composition vector $T_A$ is larger than Φ1 and not more than Φ2, the reduction rate is maintained at 100%.

When the angle β of the composition vector $T_A$ is larger than Φ2 and not more than −α, the reduction rate is reduced following the increase of the angle β. At −α, the reduction rate is 0%, that is, the engine rotation speed $N_A$ is the engine rotation speed calculated at the step S40.

Herein, Φ1 and Φ2 are angles are linearly symmetrical with −90°. For example, when Φ1 is −100°, Φ2 is −80°.

When the angle β of the composition vector $T_A$ is larger than α and not more than Φ3, the reduction rate is increased following the increase of the angle β. At Φ3, the reduction rate is 100%, that is, the engine rotation speed $N_A$ is the low idling rotation speed.

When the angle β of the composition vector $T_A$ is larger than Φ3 and not more than Φ4, the reduction rate is maintained at 100%.

When the angle β of the composition vector $T_A$ is larger than Φ4 and not more than 180°−α, the reduction rate is reduced following the increase of the angle β. At 180°−α, the reduction rate is 0%, that is, the engine rotation speed $N_A$ is the engine rotation speed calculated at the step S40.

Herein, Φ3 and Φ4 are angles are linearly symmetrical with 90°. For example, when Φ3 is 80°, Φ4 is 100°.

Φ1, Φ2, Φ3 and Φ4 can be changed within the ranges of $-180°-(-\alpha) \leq \Phi 1 < -90°$, $-90° \leq \Phi 2 < -\alpha$, $\alpha \leq \Phi 3 < 90°$, and $90° \leq \Phi 4 < 180°-\alpha$.

As mentioned above, the ship maneuvering device 1 has the pair of left and right engines 3A and 3B, the rotation speed changing actuators 4A and 4B independently changing engine rotation speeds N of the pair of left and right engines 3A and 3B, the pair of left and right outdrive devices 10A and 10B respectively connected to the pair of left and right engines 3A and 3B and rotating the screw propellers 15A and 15B so as to propel the hull 2, the forward/reverse switching clutches 16A and 16B disposed between the engines 3A and 3B and the screw propellers 15A and 15B, the pair of left and right hydraulic steering actuators 17A and 17B respectively independently rotating the pair of left and right outdrive devices 10A and 10B laterally, the joystick 21 setting the traveling direction of the ship, the operation amount detection sensor 39 detecting the operation amount of the joystick 21, and the control device 31 controlling the rotation speed changing actuators 4A and 4B, the forward/reverse switching clutches 16A and 16B, and the hydraulic steering actuators 17A and 17B so as to travel to a direction set by the joystick 21. From the operation amount of the joystick 21, the control device 31 calculates the oblique sailing component propulsion power vectors $T_{Atrans}$ and $T_{Btrans}$ for the oblique sailing of the left and right outdrive devices 10A and 10B and the turning component propulsion power vectors $T_{Arot}$ and $T_{Brot}$ for the turning, and composes the oblique sailing component propulsion power vectors $T_{Atrans}$ and $T_{Btrans}$ and the turning component propulsion power vectors $T_{Arot}$ and $T_{Brot}$ of the left and right outdrive devices 10A and 10B so as to calculates the composition vectors $T_A$ and $T_B$, thereby calculating the propulsion powers and the directions of the left and right outdrive devices 10A and 10B.

According to the construction, in comparison with the case of calculating the propulsion powers and the directions of the left and right outdrive devices 10A and 10B based on only the oblique sailing component propulsion power vectors $T_{Atrans}$ and $T_{Btrans}$ and subsequently calculating the propulsion powers and the directions of the left and right outdrive devices 10A and 10B based on only the turning component propulsion power vectors $T_{Arot}$ and $T_{Brot}$, by calculating the composition vectors $T_A$ and $T_B$ based on the oblique sailing component propulsion power vectors $T_{Atrans}$ and $T_{Btrans}$ and the turning component propulsion power vectors $T_{Arot}$ and $T_{Brot}$, the final propulsion powers and the final directions can be calculated, whereby smooth operation is obtained without setting priority and operability is improved.

When the angle β of the composition vector $T_A$ ($T_B$) is over the predetermined angle range of the outdrive devices 10A and 10B, the outdrive devices 10A and 10B are controlled so as to be made the predetermined limiting angle mode and the engine rotation speed $N_A$ ($N_B$) is reduced to the set rotation speed $N_{set}$.

According to the construction, even if the angle β of the composition vector $T_A$ ($T_B$) is over the predetermined angle range of the outdrive device 10A (10B), the steering of the outdrive devices 10A (10B) can be corrected.

When the angle β of the composition vector $T_A$ ($T_B$) is over the predetermined angle range of the outdrive device 10A (10B), the rotation angle $\theta_A$ ($\theta_B$) of the outdrive device 10A (10B) is fixed at the state of the predetermined limiting angle.

According to the construction, when the angle of the composition vector $T_A$ ($T_B$) is over the predetermined angle range of the outdrive devices 10A (10B), frequent change of the rotation angle and frequent switching of forward/reverse rotation of the outdrive device 10A (10B) is prevented.

When the angle β of the composition vector $T_A$ ($T_B$) is over the predetermined angle range of the outdrive device 10A (10B), the engine rotation speed $N_A$ ($N_B$) of the engine 3A (3B) is reduced following the reduction of the minor angle between the direction β of the composition vector $T_A$ ($T_B$) and the lateral direction of the hull.

According to the construction, when the angle β of the composition vector $T_A$ ($T_B$) is over the predetermined angle range of the outdrive devices 10A (10B), the switching of forward/reverse rotation of the outdrive devices 10A (10B) can be performed smoothly.

INDUSTRIAL APPLICABILITY

The present invention can be used for a ship having an inboard motor in which a pair of left and right engines are arranged inside a hull and power is transmitted to a pair of left and right outdrive devices arranged outside the hull.

The invention claimed is:

1. A ship maneuvering device comprising:

a pair of left and right engines;

rotation speed changing actuators independently changing engine rotation speeds of the pair of left and right engines;

a pair of left and right outdrive devices respectively connected to the pair of left and right engines and rotating screw propellers so as to propel a hull;

forward/reverse switching clutches disposed between the engines and the screw propellers;

a pair of left and right steering actuators respectively independently rotating the pair of left and right outdrive devices laterally within a predetermined angle range;

an operation device setting a traveling direction of a ship;

an operation amount detection device detecting the operation amount of the operation device; and a control device controlling the rotation speed changing actuators, the forward/reverse switching clutches, and the steering actuators so as to travel to a direction set by the operation device, wherein the control device calculates oblique sailing component propulsion power vectors for oblique sailing of the left and right outdrive devices and turning component propulsion power vectors for the turning from the operation amount of the operation device, and composes the oblique sailing component propulsion power vectors and the turning component propulsion power vectors of the left and right outdrive devices so as to calculate composition vectors, thereby calculating propulsion powers and directions of the left and right outdrive devices, wherein when the direction of the composition vector is over a predetermined angle range of the outdrive device, the outdrive device is controlled so as to be made a predetermined limiting angle mode and the engine rotation speed is reduced to a set rotation speed.

2. A ship maneuvering device comprising:

a pair of left and right engines;

rotation speed changing actuators independently changing rotation speeds of the pair of left and right engines;

a pair of left and right outdrive devices respectively connected to the pair of left and right engines and rotating screw propellers so as to propel a hull;

forward/reverse switching clutches disposed between the engines and the screw propellers;

a pair of left and right steering, actuators respective independently rotating pair of left and right outdrive devices laterally within a predetermined angle range;

an operation device setting a traveling direction of a ship;

an operation amount detection device detecting the operation amount of the operation device; and a control device controlling the rotation speed changing actuators, the, forward/reverse switching clutches, and the steering actuators so as to travel to a direction set by the operation device, wherein the control device calculates oblique sailing component propulsion power vectors for oblique sailing of the left and right outdrive devices and turning component propulsion power vectors for the turning from the operation amount of the operation device, and, composes the oblique sailing component propulsion power vectors and the turning component propulsion power vectors of the left and right outdrive devices so as to calculate composition vectors, thereby calculating propulsion powers and directions of the left and right outdrive devices, wherein when the direction of the composition vector is over a predetermined angle range of the outdrive device, a rotation angle of the outdrive device is fixed at a state of a predetermined limiting angle.

3. A ship maneuvering device comprising:

a pair of left and right engines;

rotation speed changing actuators independently changing engine rotation speeds of the pair of left and right engines;

a pair of left and right outdrive devices respectively connected to the pair of left and right engines and rotating screw propellers so as to propel a hull;

forward/reverse switching clutches disposed between the engines and the screw propellers;

a pair of left and right steering actuators respectively independently rotating the pair of left and right outdrive devices laterally within a predetermined angle range;

an operation device setting a traveling direction of a ship;

an operation amount detection device detecting the operation amount of the operation device; and a control device controlling the rotation speed changing actuators, the forward/reverse switching clutches, and the steering actuators so as to travel to a direction set by the operation device, wherein the control device calculates oblique sailing component propulsion power vectors for oblique sailing of the left and right outdrive devices and turning component propulsion power vectors for the turning from the operation amount of the operation device, and composes the oblique sailing component propulsion power vectors and the turning component propulsion power vectors of the left and right outdrive devices so as to calculate composition vectors, thereby calculating propulsion powers and directions of the left and right outdrive devices, wherein when the direction of the composition vector is over a predetermined angle range of the outdrive device, the engine rotation speed of the engine is reduced following reduction of a minor angle between the direction of the composition vector and a lateral direction of the hull.

4. A ship maneuvering device comprising:

a pair of left and right engines;

rotation speed changing actuators independently changing rotation seeds of the pair of left and right engines;

a pair of left and right outdrive devices respectively connected to the pair of left and right engines and rotating screw propellers so as to propel a hull;

forward/reverse, switching clutches disposed between the engines and the screw propellers;

pair of left and right steering actuators respectively independently rotating the pair of left and right outdrive devices laterally within a predetermined angle range;

an operation device setting a traveling direction of a ship;

an operation amount detection device detecting the operation amount of the operation device; and a control device controlling the rotation speed changing actuators, the forward/reverse switching clutches, and the steering actuators so as to travel to a direction set by the operation device, wherein the control device calculates oblique sailing component propulsion power vectors for oblique sailing of the left and right outdrive devices and turning component propulsion power vectors for the turning from the operation amount of the operation device, and composes the oblique sailing component propulsion power vectors and tie turning component propulsion power vectors of the left and right outdrive devices so as to calculate composition vectors, thereby calculating propulsion powers and directions of the left and right outdrive devices, wherein when the direction of the composition vector is over a predetermined angle range of the outdrive device, the outdrive device is controlled so as to be made a predetermined limiting angle mode and the engine rotation speed is reduced to a set rotation speed and a rotation angle of the outdrive device is fixed at a state of a predetermined limiting angle.

* * * * *